US011814826B2

(12) United States Patent
Stupp et al.

(10) Patent No.: US 11,814,826 B2
(45) Date of Patent: Nov. 14, 2023

(54) FITTING FOR DISPENSING LIQUIDS AND LIQUID DISPENSING SYSTEM

(71) Applicant: BLANCO GMBH + CO KG, Oberderdingen (DE)

(72) Inventors: Johannes Stupp, Eppingen-Mühlbach (DE); Olaf Stenvers, Mannheim (DE)

(73) Assignee: BLANCO GMBH + CO KG, Oberderdingen (DE)

( * ) Notice: Subject to any disclaimer, the term of this patent is extended or adjusted under 35 U.S.C. 154(b) by 138 days.

(21) Appl. No.: 17/496,353

(22) Filed: Oct. 7, 2021

(65) Prior Publication Data

US 2022/0112700 A1 Apr. 14, 2022

(30) Foreign Application Priority Data

Oct. 9, 2020 (DE) ..... 10 2020 212 802.2

(51) Int. Cl.
*E03C 1/04* (2006.01)
*E03C 1/044* (2006.01)
*E03C 1/046* (2006.01)

(52) U.S. Cl.
CPC ..... *E03C 1/0405* (2013.01); *E03C 1/044* (2013.01); *E03C 1/046* (2013.01); *E03C 2001/0415* (2013.01)

(58) Field of Classification Search
CPC ..... E03C 1/0405; E03C 1/044; E03C 1/046; E03C 2001/0415; E03C 1/0411; E03C 1/0404
USPC ..... 4/675–678, 567
See application file for complete search history.

(56) References Cited

U.S. PATENT DOCUMENTS 4,991,241 A * 2/1991 Bergmann ..... E03C 1/04 4/677
5,090,062 A * 2/1992 Hochstrasser ..... E03C 1/108 4/678
5,660,203 A * 8/1997 Gnauert ..... E03C 1/0403 4/677
6,233,756 B1 * 5/2001 Holbrook, Sr. ..... E03C 1/046 4/615
7,373,952 B2 * 5/2008 Gaenzle ..... E03C 1/08 4/677
11,543,043 B2 * 1/2023 Li ..... F16K 19/006
11,549,244 B2 * 1/2023 Alteon ..... E03C 1/057
(Continued)

FOREIGN PATENT DOCUMENTS

CA 2 485 484 4/2006
CA 2485484 A1 * 4/2006 ..... E03C 1/0404
(Continued)

*Primary Examiner* — Lori L Baker
(74) *Attorney, Agent, or Firm* — Wenderoth, Lind & Ponack, L.L.P.

(57) ABSTRACT

A fitting for dispensing liquids includes an outlet with a first outlet part and a second outlet part, a first liquid outflow for delivering a first of the liquids, and a second liquid outflow for delivering a second of the liquids. The first liquid outflow is arranged in the first outlet part, and the second liquid outflow is arranged in the second outlet part. The first outlet part and the second outlet part can be set movably and releasably in relation to each other. A receiving part is arranged in the first outlet part for releasably setting the second outlet part on the first outlet part, and the first liquid outflow is arranged in the receiving part.

20 Claims, 2 Drawing Sheets

(56) References Cited

U.S. PATENT DOCUMENTS

| | | | | |
|---|---|---|---|---|
| 2008/0164336 | A1* | 7/2008 | Kunkel | F21V 33/004<br>239/18 |
| 2014/0101844 | A1* | 4/2014 | Wawrla | E03C 1/0404<br>4/675 |
| 2015/0159765 | A1* | 6/2015 | Wawrla | F16K 19/006<br>4/677 |
| 2015/0292187 | A1* | 10/2015 | Tseng | E03C 1/0412<br>4/677 |
| 2015/0322651 | A1* | 11/2015 | Gnauert | E03C 1/0412<br>4/676 |
| 2019/0145533 | A1* | 5/2019 | Pirutin | F16K 11/087<br>137/896 |

FOREIGN PATENT DOCUMENTS

| | | | |
|---|---|---|---|
| CN | 2 05 841 850 | U | 12/2016 |
| EP | 2 975 185 | A1 | 1/2016 |
| WO | 2019/010078 | A1 | 1/2019 |

* cited by examiner

FITTING FOR DISPENSING LIQUIDS AND LIQUID DISPENSING SYSTEM

BACKGROUND OF THE INVENTION

1. Field of the Invention

The invention relates to a fitting for dispensing liquids, in particular water, comprising an outlet with two outlet parts,

- a first liquid outflow for delivering a first liquid, in particular treated water, preferably hot water, arranged in the first of the two outlet parts, and
- a second liquid outflow for delivering a second liquid, in particular mixed water, arranged in the second of the two outlet parts, wherein the two outlet parts can be set movably and releasably in relation to each other, The invention further relates to a liquid dispensing system, comprising a fitting.

Although the present invention can be generally applied to any fittings, the present invention is explained in relation to sanitary fittings.

Although the present invention can be generally applied to any liquids, the present invention is explained in relation to water.

2. Description of the Related Art

Sanitary fittings have become known in the most diverse ways. Known sanitary fittings comprise for example a fitting body on which an outlet is rotatably mounted. To increase the functionality, a sanitary fitting is known for example from EP 2 975 185 A1 the outlet of which comprises a vertical and a horizontal portion and has two separately arranged outflows in the horizontal portion of the outlet. The first outflow is formed in the form of an extensible showerhead and is used to deliver mixed water, the second outlet is used to deliver hot water and is fixedly arranged in the outlet.

Due to the large installation space required for the arrangement of the showerhead and the jet control receptacle of the hot water outlet, the hot water outlet is arranged near the vertical portion of the outlet. Here it is disadvantageous that the delivery of hot water is arranged disadvantageously near the vertical portion, which makes the filling of vessels with hot water significantly more difficult.

SUMMARY OF THE INVENTION

An object of the present invention is therefore to provide a fitting for the dispensing of liquids and a corresponding liquid dispensing system which enables simpler operability, a high degree of flexibility in its handling, and an inexpensive implementation.

A further object of the present invention is to provide an alternative fitting and an alternative liquid dispensing system.

The invention achieves the objects mentioned above in an embodiment for dispensing liquids, in particular water, comprising an outlet with two outlet parts,

- a first liquid outflow for delivering a first liquid, in particular treated water, preferably hot water, arranged in the first of the two outlet parts, and
- a second liquid outflow for delivering a second liquid, in particular mixed water, arranged in the second of the two outlet parts, wherein the two outlet parts can be set movably and releasably in relation to each other, characterized in that a receiving part is arranged in the first outlet part for releasably setting the second outlet part on the first outlet part, and the first liquid outflow is arranged in the receiving part.

In a further embodiment, the present invention achieves the objects mentioned above with a liquid dispensing system, comprising a fitting and a liquid treatment device comprising at least one liquid treatment module, in particular in the form of one the following liquid treatment modules:

Carbonization module,
Heating module,
Cooling module,
Filter module,
Concentration module,
Liquid delivery quantity-setting module,
Supply module,
Mineralization module, and/or
Ozonization module, which is connected to the first line of the fitting, in particular wherein at least one of the modules is arranged to be exchangeable.

The term "treated liquid" is to be understood in the broadest sense and relates to liquids, in particular water in the form of tap water from a water supplier or the like, which tap water is additionally changed in its properties and/or in its composition and/or manner of treatment by a separate device. Thus, treated water can have, for example, a high temperature, so-called hot water having a temperature of more than 80 degrees Celsius, another degree of carbonization, in part another composition or the like than water originally provided by the water supplier. The term "treated liquid" is understood not to mean in particular warm or cold water or mixed water which is commonly provided by a water supplier to a single-family home, multi-family home or the like, and which may be adjusted in its temperature by way of a heater or the like.

The term "type of treatment" is to be understood in the broadest sense and relates not only to the fundamental type of treatment of a liquid, for example whether the water was carbonized or not, but rather also to the degree, the intensity or the concentration of the treatment, for example the intensity of the carbonization. Different types of treatment are thereby understood to mean different degrees of carbonization, for example "still water", "medium" or "classic". Different types of treatment are also understood to mean different temperatures of hot water, water filtered to varying degrees, different concentrations of flavoring additives or aromatizations, different types of mineralization, and different concentrations of the same type of mineralization or the like. The term "type of treatment" also includes, in particular, "non-treatment".

One of the advantages thereby achieved is that the flexibility with respect to the arrangement of the outlets and the design of the outlet is thereby increased. A further advantage is a simple and inexpensive assembly of the fitting. A further advantage is that the safety and reliability of the dispensing of treated water for a user of the fitting is substantially increased.

Further features, advantages and embodiments of the invention are described below or are disclosed therein.

According to an embodiment, the second outlet part is formed in the shape of an extensible showerhead. This is advantageous in that the operability of the fitting for a user is further improved.

According to a further embodiment, the horizontal distance between the liquid outflows is at least 75% of the horizontal distance between a base body and the first liquid out-flow when the second outlet part is set in the receiving part. This is advantageous in that a particularly simple tapping of liquids and a reliable and safe filling of vessels with the liquids is enabled.

According to a further embodiment, the first liquid outflow is connected to a first line and the second liquid outflow is connected to a second line, wherein at least one of the two lines is made of flexible material and/or plastic. An advantage of this is a simple production and assembly to tap two liquids via two outflows. If for example the first outlet part is a fixed outflow for functional or treated water, then scalding in case of inadvertently incorrect operation can be prevented when the second outlet part is designed as an extensible showerhead.

According to a further embodiment, the second line is conducted asymmetrically, at least in the region of the receiving part. A simple assembly of the second outlet part, including the second line together with the arrangement of the first liquid outflow, is enabled.

According to a further embodiment, the second line is conducted through the receiving part in the upper region. The advantage of this is a particularly simple assembly of the second liquid outflow in the lower region of the receiving part.

According to a further embodiment, the receiving part and the first outlet part are formed in such a way that the receiving part can be inserted into the first outlet part and can be releasably set therein. The advantage of this is that the first outlet part can be releasably set in a particularly simple manner.

According to a further embodiment, the receiving part can be set on the first outlet part by means of an element of the first liquid outflow, in particular by means of a jet former or jet control. This enable an inexpensive and simple setting of the receiving part in the first outlet part, since separate fastening elements can be dispensed with.

According to a further embodiment, the outlet substantially comprises a vertical and a horizontal running region, wherein the receiving part and at least the second outlet part is arranged in the horizontally running region. In addition to the advantage of a high-quality optical impression, simple operability of the outlet is enabled.

According to a further embodiment, the first outlet part is curved, in particular it is formed substantially in an L or C shape. One of the advantages thereby achieved is a simple producibility and a simple handling.

According to a further embodiment, the outlet is designed at least in part in the shape of a cylinder and a bending radius of the outlet is more than twice as large as the diameter of the outlet. In addition to a high-quality optical impression, this also provides installation space for the first and the second line of the two liquid discharges in the outlet.

According to a further embodiment, the receiving part is made at least in part of plastic. This enables inexpensive production.

According to a further embodiment, the outlet comprises an outer shell, which in particular is made at least in part made of metal. Possible advantages of an outer shell made of metal are the high resistance against ambient influences and a high-quality optical impression of the outlet.

According to a further embodiment, the first and/or the second line is arranged at least in part at a distance from the outer shell in the interior of the outlet. In the intermediate space created thereby, an insulating layer of air or an insulating material can thereby, for example, be arranged, in order to avoid burns in the operation of the outlet, for example. A formation of condensation on the outlet when dispensing cold liquids can also thereby be avoided.

According to an embodiment, the first line is formed for hot water flowing through at a temperature of more than 90 degrees Celsius, in particular more than 95 degrees Celsius. The advantage of this is that the first liquid outflow is also formed for the delivery of hot water, which increases flexibility in the provision of different liquids and/or a liquid with different types of treatment.

It is understood that the above-mentioned features and features yet to be explained, not only may not only be used in the respectively indicated combination, but rather also in other combinations or alone, without departing from the scope of the present invention.

BRIEF DESCRIPTION OF THE DRAWINGS

Preferred designs and embodiments of the invention are presented in the drawings and explained further in the description below, wherein identical reference numerals refer to identical or similar or functionally similar components or elements.

In the drawings.

DETAILED DESCRIPTION OF THE INVENTION

Figure 1:
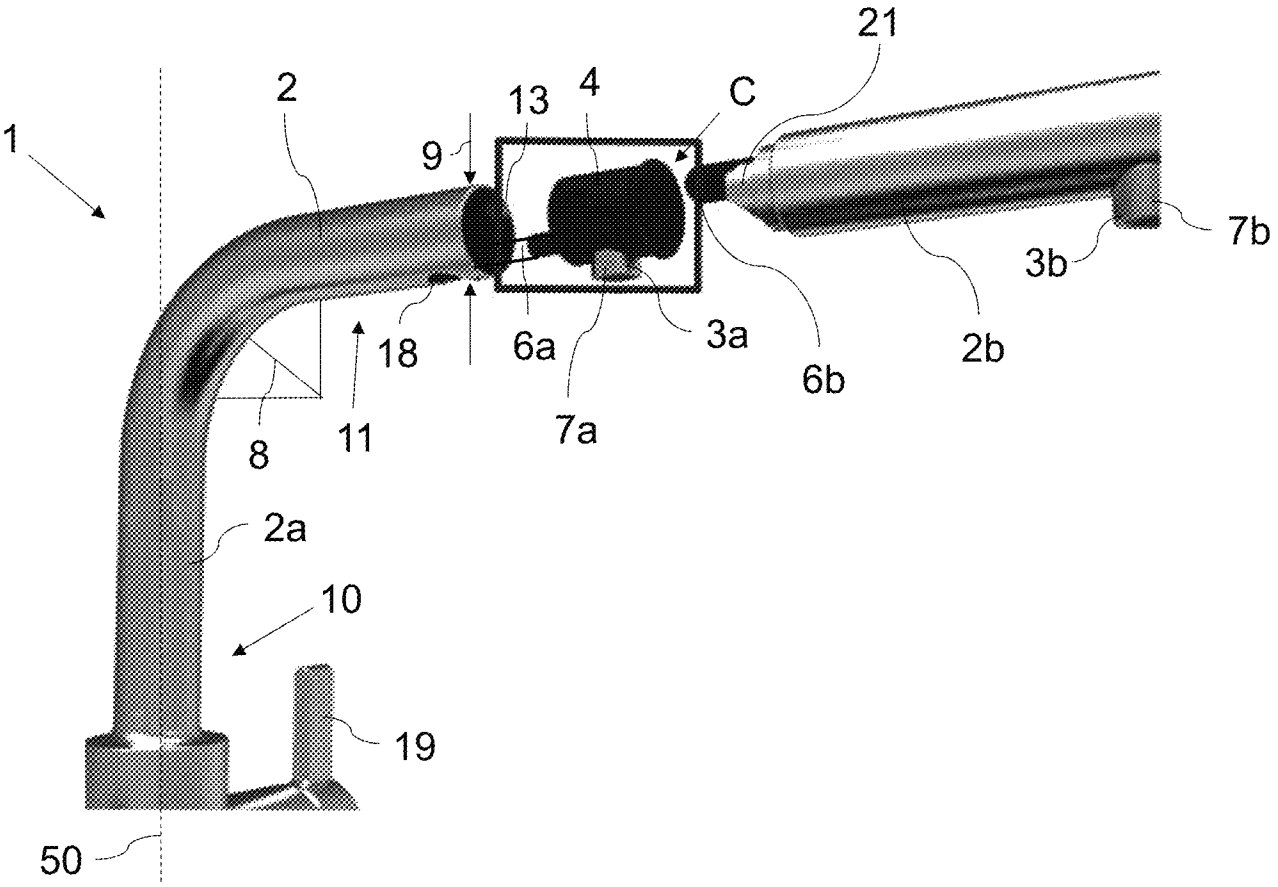
FIG. 1 shows a fitting in an exploded view according to one embodiment of the present invention.
Figure 2:
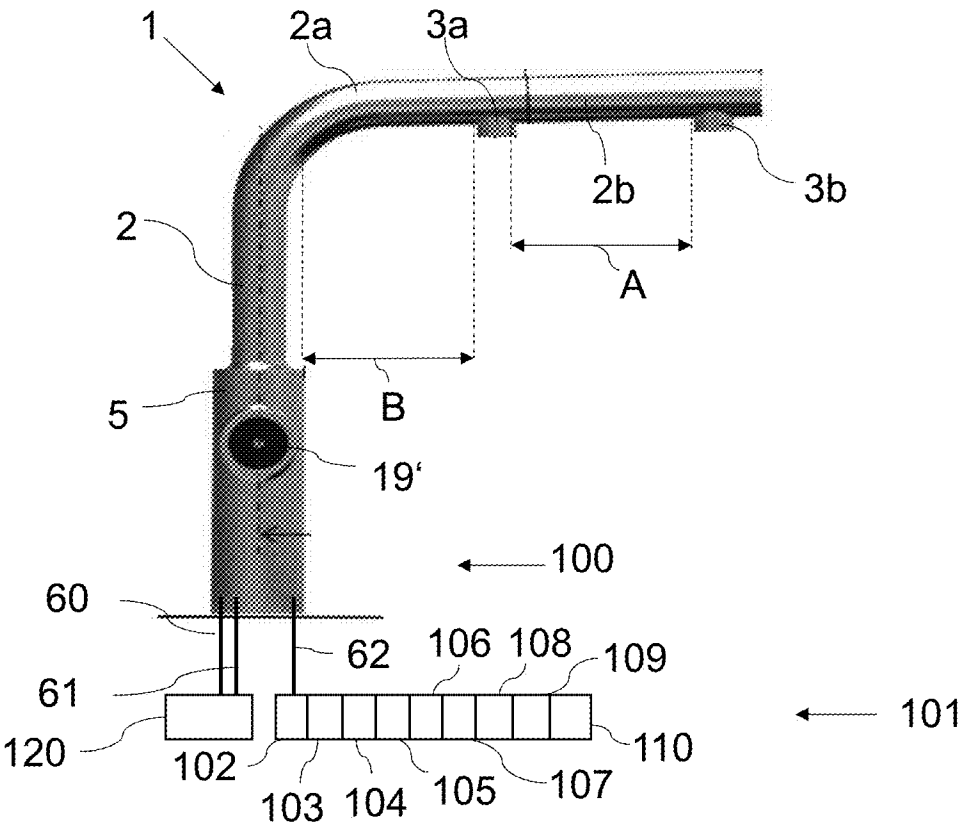
FIG. 2 shows a lateral and in part schematic view of the fitting according to FIG. 1.

In detailed view, FIGS. 1 and 2 show a sanitary fitting 1, for example for a sink in a kitchen. Here the sanitary fitting 1 comprises an outlet 2 rotatably mounted about a vertical axis 50 in a base body 5 On the base body 5, corresponding operating elements 19 may be arranged for providing mixed water or treated water by way of various water outflows 3*a*, 3*b* of the outlet. The outlet 2 is constructed in two parts and comprises a substantially L-shaped outlet part 2*a* having a vertical and horizontal region 10, 11 and a second straight outlet part 2*b* in the horizontal region 11 of the outlet 2. Each outlet part 2*a*, 2*b* comprises a water outflow 3*a*, 3*b*. Both outlet parts 2*a*, 2*b* are formed to be circular and hollow in cross-section in the interior. In other words, an outer shell 13 is formed, so that lines 6*a*, 6*b* can be conducted therein. This lines 6*a*, 6*b* are flexibly formed hoses and are each connected to one of the water outflows 3*a*, 3*b*. The bending radius 8 of the first outlet part 2*a* in the transition between the two regions 10, 11 is more than twice as large here as the diameter 9 of the outer shell 13 of the outlet 2. The outer shell 13 may be made for example of metal, the lines 6*a*, 6*b*, 60, 61, 62 may be made of polysiloxane, polytetrafluorethylene or silicone, and a receiving part 4 described in the following may be made of plastic.

Furthermore, on the end of the first outlet part 2*a* oriented toward the second outlet part 2*b*, the receiving part 4 is inserted into the first outlet part 2*a*. The receiving part 4 is fixed in this by screwing a jet control 7*a* into a corresponding receptacle in the receiving part 4 by way of a corresponding opening 18 in the outer shell 13 of the first outlet part 2*a*. One or several holding elements may be arranged or used for this. The second outlet part 2*b* also has on its water outflow 3*b* a jet control 7*b*. The second outlet part 2*b* is further formed as a showerhead and can be fixed to the first outlet part 2*a* by means of the receiving part 4. The line 6*b* is conducted here at least in the region of the receiving part 4 in the upper region C of the receiving part 4, and in the lower region, the water outflow 3*a* is arranged for the first outlet part 2*a*. The diameter of the outlet parts 2*a*, 2*b* can be dimensioned or designed here such that the two lines 6*a*, 6*b* are designed to be spaced apart from the outer shell 13 in the interior of at least the first outlet part, for example spaced by an insulating layer or the like. The distance B between the base body 5 and the first water outflow 3*a* is larger here than the distance A between the two water outflows 3*a*, 3*b* when the second outlet part 2*b* is releasably fixed to the first outlet part 2*a* by means of the receiving part 4. This enables a long second outlet part 2*b*, which improves the grip of the same. The releasable arrangement can for example be done by partial insertion of an element or portion 21 of the second outlet part 2*b* into the receiving part 4 or the like.

In FIG. 2, a water dispensing system 100 is shown which one the one hand comprises two lines 60, 61 for providing cold and warm water, which can ultimately be dispensed as mixed water by actuating corresponding operating elements 19 by way of a mixed water battery not shown here via the second water outflow 3*b*. The two lines 60, 61 are connected here to a domestic water connection 120 for cold and warm water. The first water outflow 3*a* is connected to a water treatment module arrangement by way of a line 6*a* connected to it and possibly by way of a further line 62—only shown schematically here. The water treatment module arrangement 101 may also be actuated with corresponding operating elements 19' which may for example also be arranged on the base body 5. The operating elements 19, 19' may de deigned mechanically, electronically, pneumatically, hydraulically (or in any combination thereof).

This water treatment module arrangement may for example comprise one or several of the following modules:

- A carbonization module 102 for providing carbonated water,
- a hot water module 103 for providing hot water having a temperature of more than 95 degrees C.,
- a cooling module 104 for providing cooled water,
- a filter module 105 for providing filtered water, in particular water with reduced calcium content,
- a concentration module 106 for providing and/or enriching water with one or several concentrates, for example fruit juice concentrate for delivering fruit juice beverages or the like,
- a water delivery quantity-setting module 107 for providing a defined quantity of treated or untreated water,
- a supply module 108 for supplying a predefinable quantity of treated water,
- a mineralization module 109 for adding minerals and/or
- an ozonization module 110 for ozonizing water, The delivery of the water treated by the water treatment module arrangement 101 is done by way of the first water outflow 3*a*. The individual modules 102-110 may be exchangeably arranged in their entirety—for example the entire filter module may be removed and possibly replaced by a carbonization module—and/or with respect to its components, such a filter in the filter module or the like.

In summary, at least one of the embodiments of the invention has at least one of the following advantages:

- High-quality optical impression.
- Simple and inexpensive production and assembly.
- Simple and safe delivery of mixed water and treated water.
- Larger gripping area due to greater distance between the two water outflows.
- Simple operation, in particular through the formation of an outlet part as showerhead.

Although the present invention was described using preferred embodiments, it is not limited to these, but rather may be modified in various ways.

LIST OF REFERENCE NUMERALS

1 Fitting
2 Outlet
2*a* First outlet part
2*b* Second outlet part
3*a* First liquid outflow
3*b* Second liquid outflow
4 Receiving part
5 Base body
6*a* First line
6*b* Second line
7*a, b* Elements
8 Bending radius
9 Diameter of the outlet
10 Vertically running region
11 Horizontally running region
13 Outer shell
18 Opening
19 Operating element
21 Element/portion of second outlet part
50 Vertical axis
60, 61, 62 Lines
100 Liquid dispensing system
101 Liquid treatment device
102 Carbonization module
103 Heating module
104 Cooling module
105 Filter module
106 Concentration module
107 Liquid delivery quantity-setting module
108 Supply module
109 Mineralization module
110 Ozonization module
120 Hot water connection
A Horizontal distance between liquid outflows
B Horizontal distance between base body and first liquid outflow
C Upper region

The invention claimed is:

1. A fitting for dispensing liquids, the fitting comprising:
an outlet with a first outlet part and a second outlet part, the first outlet part and the second outlet part being movable and releasable in relation to each other;
a first liquid outflow for delivering a first of the liquids, the first liquid outflow being arranged in the first outlet part;
a second liquid outflow for delivering a second of the liquids, the second liquid outflow being arranged in the second outlet part; and
a receiving part for releasably setting the second outlet part on the first outlet part, the receiving part being arranged in the first outlet part and the first liquid outflow being arranged in the receiving part.

2. The fitting according to claim 1, wherein a shape of the second outlet part is an extensible showerhead.

3. The fitting according to claim 1, wherein a horizontal distance between the first liquid outflow and the second liquid outflow is at least 75% of a horizontal distance between a base body and the first liquid outflow when the second outlet part is set in the receiving part.

4. The fitting according to claim 1, wherein:

the first liquid outflow is connected to a first line and the second liquid outflow is connected to a second line; and the first line or the second line is made of flexible material or plastic.

5. The fitting according to claim 1, wherein the second line is defined asymmetrically in the receiving part.

6. The fitting according to claim 5, wherein the second line is defined in an upper region through the receiving part.

7. The fitting according to claim 1, wherein the receiving part is insertable into the first outlet part and is releasably settable in the first outlet part.

8. The fitting according to claim 7, wherein the receiving part is settable on the first outlet part via of an element of the first liquid outflow.

9. The fitting according to claim 1, wherein:

the outlet includes a vertical region and a horizontal region; and the receiving part and the second outlet part are arranged in the horizontal region of the outlet.

10. The fitting according to claim 9, wherein the first outlet part is curved.

11. The fitting according to claim 10, wherein:

at least part of the outlet is cylindrical; and a bending radius of the outlet is more than twice as large as a diameter of the outlet.

12. The fitting according to claim 1, wherein at least part of the receiving part is made of plastic.

13. The fitting according to claim 1, wherein the outlet includes an outer shell.

14. The fitting according to claim 13, wherein at least part of the first line or at least part of the second line is arranged at a distance from the outer shell in an interior of the outlet.

15. The fitting according to claim 1, wherein the first line is configured to allow water at a temperature of more than 90 degrees Celsius to flow therethrough.

16. The fitting according to claim 8, wherein the element of the first liquid outflow is a jet former or a jet control.

17. The fitting according to claim 1, wherein a shape of the first outlet part is an L or a C.

18. The fitting according to claim 13, wherein at least part of the outer shell is made of metal.

19. A liquid dispensing system comprising:

a fitting for dispensing liquids; and a liquid treatment device, wherein the fitting includes:

an outlet with a first outlet part and a second outlet part, the first outlet part and the second outlet part being movable and releasable in relation to each other;

a first liquid outflow for delivering a first of the liquids, the first liquid outflow being arranged in the first outlet part;

a second liquid outflow for delivering a second of the liquids, the second liquid outflow being arranged in the second outlet part; and a receiving part for releasably setting the second outlet part on the first outlet part, the receiving part being arranged in the first outlet part and the first liquid outflow being arranged in the receiving part, wherein:

the liquid treatment device includes at least one liquid treatment module;

the at least one liquid treatment module is a carbonization module, a heating module, a cooling module, a filter module, a concentration module, a liquid delivery quantity-setting module, a supply module, a mineralization module, or an ozonization module;

the first liquid outflow is connected to a first line; and the at least one liquid treatment module is connected to the first line of the fitting.

20. The liquid dispensing system according to claim 19, wherein the at least one liquid treatment module is exchangeable.

* * * * *